US005433050A

United States Patent [19]

Wilson et al.

[11] Patent Number: 5,433,050

[45] Date of Patent: Jul. 18, 1995

[54] VENTED INSULATION PANEL WITH FOAMED SPACER MEMBERS

[75] Inventors: Allan L. Wilson, Marietta, Ga.; Andy I. McLaughlin, Meridian, Miss.; William E. Todd, Marietta, Ga.; Ronald Jadlocki; Russell D. Addison, both of La Grange, Ga.; Timothy L. Lagod, Marietta, Ga.

[73] Assignee: Atlas Roofing Corporation, Meridian, Miss.

[21] Appl. No.: 149,740

[22] Filed: Nov. 10, 1993

Related U.S. Application Data

[63] Continuation-in-part of Ser. No. 820,482, Jan. 14, 1992, abandoned.

[51] Int. Cl.[6] ..... E04C 2/36

[52] U.S. Cl. ..... 52/302.1; 52/281; 52/481.1; 52/790.1; 52/799.11

[58] Field of Search ..... 52/239, 241, 281, 481.1, 52/793, 302.1, 817; 428/314.4, 318.4, 120, 114, 119

[56] References Cited

U.S. PATENT DOCUMENTS

| | | | |
|---|---|---|---|
| 1,028,725 | 6/1912 | Hodgson . | |
| 3,006,113 | 10/1961 | Barnes et al. | 52/95 |
| 3,086,323 | 4/1963 | Pine . | |
| 3,295,278 | 1/1967 | Muhm | 52/223 |
| 3,363,378 | 1/1968 | Palfey | 52/309.2 |
| 3,488,904 | 1/1970 | Schneller et al. | 52/241 |
| 3,595,728 | 7/1971 | Robson | 161/53 |
| 3,748,803 | 7/1973 | Widerby et al. | 52/303 |
| 3,756,895 | 9/1973 | Bellamy | 156/257 |
| 4,333,290 | 6/1982 | Roberstein | 52/407.4 |
| 4,382,435 | 5/1983 | Brill-Edwards | 126/429 |
| 4,418,507 | 12/1983 | Roberts et al. | 52/309.11 |
| 4,429,503 | 2/1984 | Holliday | 52/410 |
| 4,635,419 | 1/1987 | Forrest | 52/303 |
| 4,852,314 | 8/1989 | Moore, Jr. | 52/199 |
| 5,010,810 | 1/1992 | Emmert | 52/309.4 |

FOREIGN PATENT DOCUMENTS

| | | | |
|---|---|---|---|
| 52454 | 8/1974 | Australia | 52/407.5 |
| 1281133 | of 0000 | Germany . | |
| 3302728 | 8/1983 | Germany | 52/144 |
| 197807 | of 0000 | Netherlands . | |
| 1097452 | of 0000 | United Kingdom | B32B 3/10 |
| 775258 | of 0000 | U.S.S.R. . | |

OTHER PUBLICATIONS

Popular Science, vol. 229, No. 4 Oct. 1986, p. 46.

Vent-Top ThermaCal Ventilated Roof Insulation brochure, dated Sep. 1, 1990.

European Application 0,398,586, publishe Nov. 22, 1990, 1 page dwg, 5 pages spec.

"Panoflo Vented Nail Base Insulation", Technical Data, Universal Building Specialities.

"Branch River Air-Flo Panel System", Branch River Foam Plastics Incorporated.

*Primary Examiner*—Carl D. Friedman

*Assistant Examiner*—Christopher T. Kent

*Attorney, Agent, or Firm*—Nixon & Vanderhye

[57] ABSTRACT

A thermally insulative building construction panel (10) comprises a first or bottom sheet (20) of insulation material; a second or top sheet (24) of a rigid nail-anchoring material; and, a plurality of spacer members (22) sandwiched in fixed positions between the first sheet and the second sheet for defining air channels (25) between the sheets and the spacer members. The spacer members (22) are over three inches wide and are at least one-half inch thick. The spacer members (22) are comprised of a plastic foam insulation material selected from the group consisting of polyurethane modified polyisocyanurate foam, phenolic-formaldehyde foam, and polystyrene foam.

19 Claims, 2 Drawing Sheets

VENTED INSULATION PANEL WITH FOAMED SPACER MEMBERS

This is a continuation-in-part application of United States patent application Ser. No. 07/820,482, filed Jan. 14, 1992, now abandoned, which is incorporated herein by reference.

BACKGROUND

1. Field of Invention

This invention relates to insulation panels used for building construction, and particularly to insulation panels used for roofing construction.

2. Prior Art and Other Considerations

An effective prefabricated thermal insulation panel is inherently self-destructing. That is, in insulating a building for the purpose of conserving energy, the panel stores high levels of heat. Such intense heat is deleterious to the panel structure per se. This heat build-up problem is especially acute in the roofing environment. The heat build-up problem is especially severe when the insulation panel comprises a sheet of high efficiency plastic foam.

The prior art includes panels wherein air circulation is provided to keep the panels as cool as possible. Examples of such prior art panels include those illustrated in U.S. Pat. No. 4,852,314 to Moore, Jr.; U.S. Pat. No. 4,635,419 to Forrest; U.S. Pat. No. 4,254,598 to Rugroden; U.S. Pat. No. 3,756,895 to Bellamy; and, U.S. Pat. No. 1,028,725 to Hodgson.

The prior art insulation panels such as those listed above generally comprise two flat sheets which are oriented parallel to one another and spaced apart by a plurality of spacer members sandwiched therebetween. The spacer members are positioned relative to one another to define air channels. The air channels are thus bordered above and below by the flat sheets and are laterally bounded by the spacer members. The channels allow air to pass between the top deck and the insulation board, thus causing a cooling effect on all components.

In the effort to keep costs down, most manufacturers have used wooden ¾ thick inch "furring strips" as the spacer members. These furring strips are less than three inches wide, and thus may require as many as five strips to be placed within a forty-eight inch length. When wood furring strips are used as the spacer members to create the air channels, the wood lowers the thermal resistance values (increases thermal conductance) of the insulative building panel within the area where wood furring strips are used. In Northern winters, these areas can be seen on a roof as strips of melted snow.

All building products manufacturers have experienced strong incentive to reduce manufacturing costs. The need to obtain improved performance and yet reduce costs persists.

It is therefore an object of the present invention to provide a vented, insulative building panel having even insulation distribution.

An advantage of the present invention is the provision of an insulative building panel the construction of which avoids using new and unused lumber as furring strips, thereby conserving one of the earth's precious natural resources.

A further advantage of the present invention is the provision of an insulative building panel which advantageously utilizes scrap, or waste, materials as spacer members, which materials would otherwise be discarded and further congest refuse disposal facilities such as landfills.

Another advantage of the present invention is the provision of an insulative building panel which reduces the number of spacer members required along any given dimension.

Still another advantage of the present invention is the provision of a lighter weight vented insulation panel having comparable load bearing strength.

Yet another advantage of the present invention is the ability to make insulative building panels according to the invention having an essentially unlimited range of cross sectional ventilating channel area, while maintaining compressive load and strength requirements.

Another advantage of the present invention is the provision of an insulation panel with better thermal resistance per equal thickness when compared to prior art panels.

Yet another advantage of the present invention is the provision of an insulation panel which requires less expense to manufacture, thus lowering the cost of building construction, particularly for sloped roofs.

SUMMARY

A thermally insulative building construction panel comprises a first or bottom sheet of insulation material; a second or top sheet of a rigid nail-anchoring material; and, a plurality of spacer members sandwiched in fixed positions between the first sheet and the second sheet for defining air channels between the sheets and the spacer members. The spacer members are over three inches wide, preferably over four inches wide, and are at least one-half inch thick. The spacer members are comprised of a plastic foam insulation material selected from the group consisting of polyurethane modified polyisocyanurate foam, phenolic-formaldehyde foam, and polystyrene foam.

The spacer members of the panel include edge spacer members and intermediate spacer members. The intermediate spacer members have a greater width than the edge spacer members. The width of the edge spacer members is on the order of about four inches; the width of the intermediate spacer members is on the order of about six inches.

An edge channel defined by an edge spacer member and an intermediate spacer member has a channel width which is less than the channel width of a channel between two intermediate spacer members.

The spacer members have a facer material provided on at least one surface thereof. The facer material is comprised of a material selected from the group consisting of aluminum foil, kraft paper, coated glass, glass-reinforced felt, and matted glass.

Thus, the spacer members can advantageously be formed from scrap, or waste, plastic foam insulation material such as insulation board material of the type utilized for wall insulation or the like.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating principles of the invention.

DETAILED DESCRIPTION OF THE DRAWINGS

Figure 1:
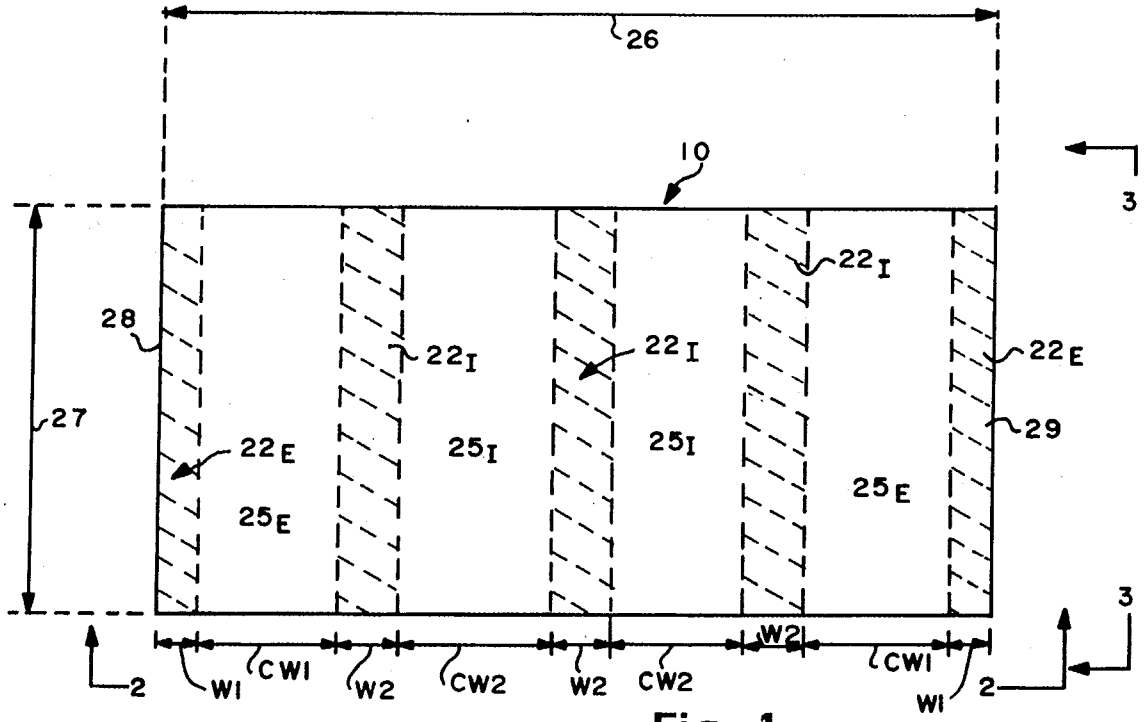
FIG. 1 is a plan view of a vented insulation panel according to an embodiment of the invention.

FIG. 1 shows a prefabricated vented insulation panel 10. The panel 10 comprises a first sheet 20; a plurality of spacer members 22; and a second sheet 24. The sheets 20 and 24 lie in parallel planes and are maintained in spaced parallel relationship by the spacer members 22. In this regard, the spacer members 22 are sandwiched in fixed positions between the first sheet 20 and the second sheet 24 for defining air channels 25 between the sheets 20, 24 and the spacer members 22.

As shown in FIG. 1, the panel 10 extends across a first dimension as depicted by an arrow bearing reference number 26. In the illustrated embodiment, the panel 10 extends approximately eight feet across the dimension of arrow 26 (sometimes referred to as the "width" dimension). The extent of the panel 10 across an orthogonal dimension (represented by arrow 27) is approximately four feet. As explained in more detail below, the spacer members 22 extend over three inches along the dimension of arrow 26 and are at least one-half inch thick. As used herein, when referring to the panel 10 per se, the term "thick" or "thickness" refers to a dimension which is perpendicular a the plane in which arrows 26 and 27 lie.

The panel 10 has a first edge 28 and a second edge 29 parallel to the first edge 28. Of the spacer members 22, edge spacer members $22_E$ positioned proximate the first edge 28 and the second edge 29 have a first width W1 along the dimension of arrow 26. Intermediate spacer members $22_I$ positioned between the first edge 28 and the second edge 29 have a width W2 along the dimension of arrow 26. The width W2 is greater than the width W1. In the illustrated embodiment, the width W1 is on the order of about four inches, and the width W2 is on the order of about six inches.

An edge channel $25_E$ defined by a edge spacer member $22_E$ and an intermediate spacer member $22_I$ has a channel width CW1 along the first dimension of arrow 26. An intermediate channel $25_I$ defined by two intermediate spacer members $22_I$ has a channel width CW2 along the dimension of arrow 26. The width CW2 is greater than the width CW1. In the illustrated embodiment, the channel width CW1 is on the order of about seventeen inches, and the width CW2 is on the order of about eighteen inches. The channel width CW2 being greater than the width CW1 facilitates the spacer members 22 being centered on a normal nail-down pattern, which is preferable. However, in other embodiments the all channels can have essentially the same width, preferably being in a range from about seventeen to eighteen inches.

The first sheet 20 is comprised of a structurally sound plastic foam insulation material. For example, the first sheet 20 can be comprised of polyurethane modified polyisocyanurate foam, phenolic-formaldehyde foam, or polystyrene foam. The first sheet 20 preferably has facers provided on both of its broad, flat surfaces. Inclusion of a facer on the sheet 20 enhances application of a construction adhesive to the sheet 20.

First sheet 20 has a density less than 5 lb./cubic foot and an insulative "R" value in excess of 5.0 per inch thickness. An "R" value is defined as the resistance to thermal conductivity in units of $$\frac{\text{(square feet)} \times \text{(degrees F)} \times \text{(seconds)}}{\text{(British Thermal Unit [BTU])}}.$$

The second sheet 24, also known as the top deck, comprises a rigid nail-anchoring material. The sheet 24 can be any ordinary roofing deck material normally used as a nail base for roofing felt and shingles, such as plywood, waferboard, oriented strand board, and particle board. Second sheet 24 has a density in excess of 25 lb./cubic foot, and holds ordinary nail shanks. The insulative "R" value of sheet 24 is a maximum of 2.3 per inch thickness. The preferred materials for the top sheet 24 are 7/16" Oriented Strand Board (OSB), ½" plywood, or 7/16" Waferboard. The most preferred material is either Waferboard or OSB, as plywood often has concealed, interior voids.

Figure 4:
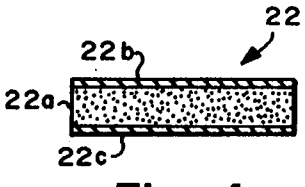
FIG. 4 is a sectioned side view of a spacer member which comprises the panel of FIG. 1.
Figure 3:
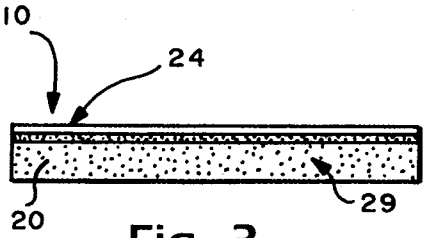
FIG. 3 is an end view taken along line 3—3 of the panel of FIG. 1.
Figure 2:
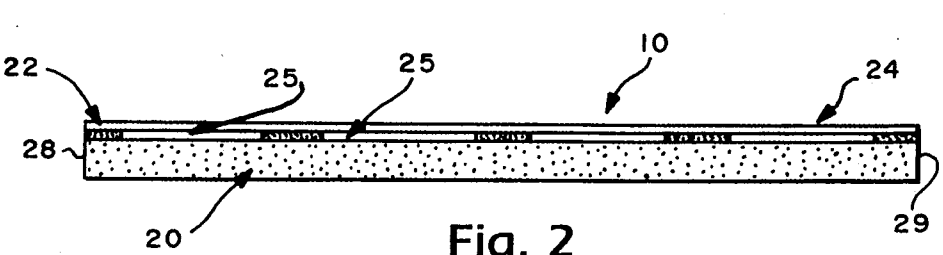
FIG. 2 is a side view, taken along line 2—2, of the panel of FIG. 1.

The spacer members 22 have a generally elongated rectangular shape and, as shown in FIG. 4, are of rectangular cross section. The spacer members 22 of the present invention are of the same extent along dimension 27 as is the composite panel 10. This adds both insulation value and strength to support the nail base deck 24 all the way to all four edges of the deck 24.

In the preferred embodiment, the spacer members 22 comprise a plastic foam core **22*a* which has a top facer 22*b* and a parallel, opposing bottom facer 22*c* adhered thereto. In preferred embodiments, the core 22*a* of the spacer members 22** is comprised of polyurethane modified polyisocyanurate foam, phenolic-formaldehyde foam, or polystyrene foam.

The material comprising facers **22*b* and 22*c* is comprised of a material selected from the group consisting of aluminum foil, kraft paper, coated glass, glass-reinforced felt, and matted glass. For example, the facer can be aluminum foil; a laminate having alternating layers of aluminum foil and kraft paper (aluminum foil-kraft paper-aluminum foil); coated glass mat; glass-fiber reinforced felt; and, non-woven glass fiber mat. In the most preferred embodiment the spacer members 22 have a core 22*a*** of polyurethane modified polyisocyanurate foam with a facer on both sides.

The spacer members 22 can thus be shaped, cut, or otherwise formed from scraps or left-over portions of insulation board products. An example of such a board is a ½ inch thick board marketed by Atlas Roofing Corporation as ENERGY SHIELD.

In one embodiment, the spacer members 22 are secured in place by a construction grade adhesive such as an adhesive of the type known as a subfloor and deck adhesive. Contech's PL-400, H B Fuller's "Sturdibond" and Macklenburg-Duncan's "MD 400" are examples of appropriate construction grade adhesives. In other embodiments, the spacer members 22 can be secured in place by hot melt gluing techniques, or by mechanical fastening (including broad headed nails and/or staples).

Thus the panel 10 of the present invention constitutes a distinct improvement over prior art ventilating and insulating panels. Instead of using a wooden product as the spacing elements between the nail-base deck on the top, and the plastic foam insulation board on the bottom, the present invention utilizes wider spacing members 22. Moreover the spacing members 22 have better insulating qualities. By using end spacer members $22_E$ having at least a three inch and preferably a four inch width along dimension 26, intermediate spacer members $22_I$ having at least six inch widths along dimension 26, and by having approximately 24 inches between centers of intermediate spacer members $22_I$, the load bearing strength of the panel 10 is at least 524 pounds per square foot average. Also, when properly installed, the Model Building Code requirements for the minimum amount of cross sectional ventilating area are satisfied.

Figure 5:
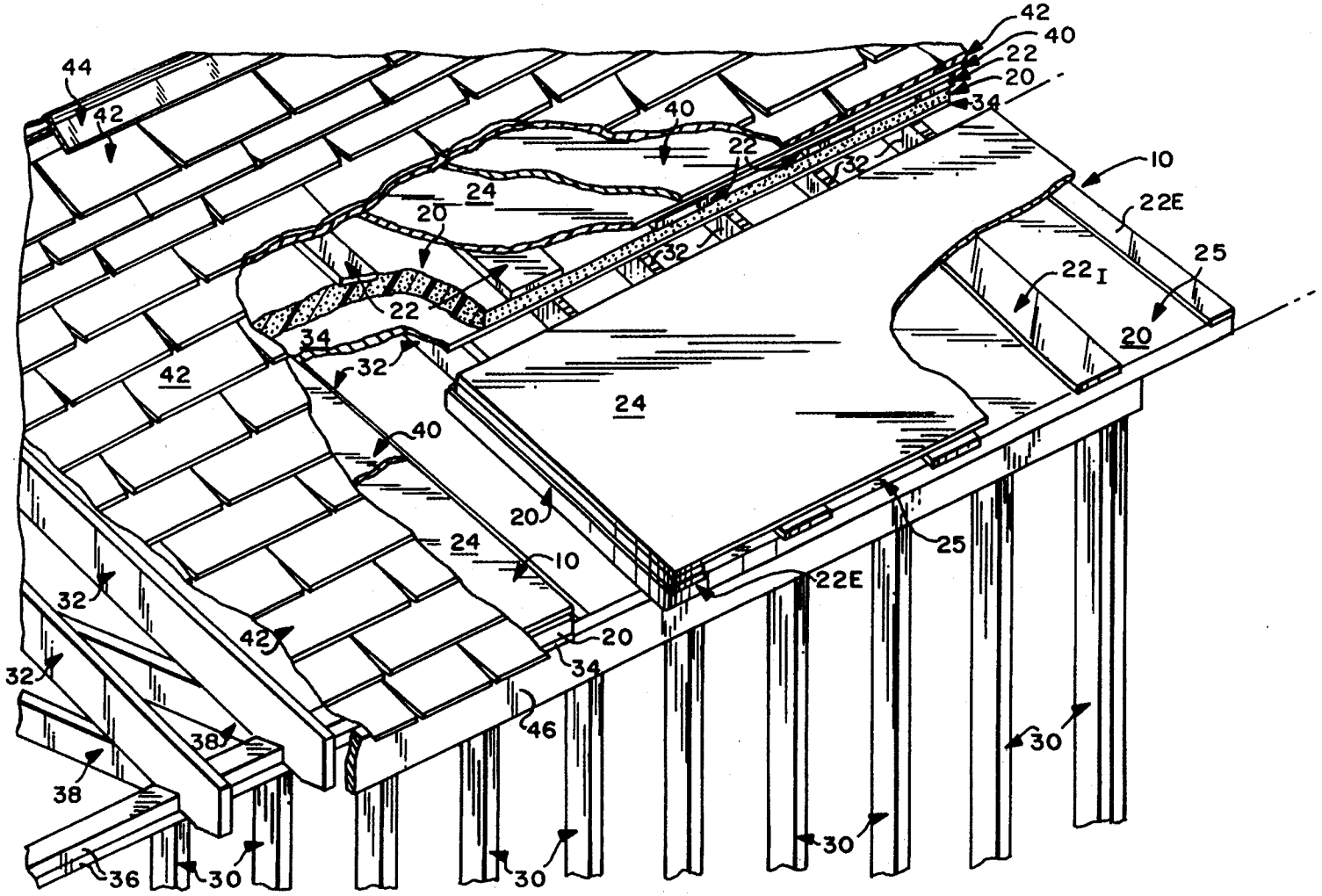
FIG. 5 a partial perspective view, partially sectioned, of a the vented insulation panel of the embodiment, of FIG. 1 installed on a sloped roof.

FIG. 5 shows the prefabricated vented insulation panel 10 of the embodiment of FIG. 1 installed in a typical sloped roof environment. The panel is illustrated as being utilized on a building having vertical studs 30. The studs 30 support roof framing members, with the roof framing members in turn supporting the panel 10.

The roof framing members include rafters 32 for supporting underdecking 34. Top plates 36 are employed to fasten the rafters 32 and joists 38 to the studs 30. The rafters 32 are tied together by the structural load-bearing underdecking 34.

Overlying the panel 10 is a conventional roofing membrane system comprising a base sheet 40 overlaid with shingles 42, which act as the waterproofing element on top. A vent cap 44 is provided at the roof ridge. The function of the vent cap 44 is explained in prior art publications, such as U.S. Pat. No. 4,852,314 to Moore, which is incorporated herein by reference.

A soffit side-fascia 46 is usually nailed to the ends of the rafters 32 and/or joists 38. If an open-beam (e.g., Cathedral ) ceiling design is utilized, (i.e., no joists and no attic), the roof structural under-decking 34 becomes the ceiling. In this case, the space between the rafters 32 must be closed up with vertical wall structures, plus wall plates, against the under-decking 34.

The use of plastic foam spacer members 22 provides for a more even distribution of the desired insulation over the entire area of the building panel. This invention obviates the former requirement of using new lumber as furring strips, which former use further depleted one of the earth's precious natural resources. Moreover, the panel 10 of the present invention is of lighter weight and yet has comparable strength and superior insulation efficiency over the whole area of the panel. The panel 10 is less expensive to manufacture, thus lowering the cost of building construction. Importantly, by utilizing scrap, or waste, plastic foam insulation material as spacer members 22, the problem of refuse disposal is mitigated.

Thus, the panel 10 of the present invention affords improved total insulation value as well as better distribution of insulation, reduced manufacturing costs, and at the same time improves the load bearing distribution over the whole area of the panel 10. Importantly, the insulation panel of the present invention can be manufactured so that the air channels thereof have any desired thickness, and thus any desired cross-sectional area. Essentially unlimited ventilating channel cross-sectional thickness is thus facilitated without sacrificing compressive and load-bearing strength requirements.

While the invention has been particularly shown and described with reference to the preferred embodiments thereof, it will be understood by those skilled in the art that various alterations in form and detail may be made therein without departing from the spirit and scope of the invention.

The embodiments of the invention in which an exclusive property or privilege is claimed are defined as follows:

1. A thermally insulative building construction panel comprising:

a first sheet, the first sheet comprising an insulation material having a density less than 5 lb./cubic foot and an insulative "R" value in excess of 5.0 per inch thickness;

a second sheet, the second sheet comprising a rigid nail-anchoring material having a density in excess of 25 lb./cubic foot;

a plurality of spacer members connected in fixed positions between the first sheet and the second sheet for defining air channels between the sheets and the spacer members, the spacer menders being directly connected to the first sheet and the second sheet for maintaining a spaced parallel relationship between the first sheet and the second sheet, the spacer members comprising plastic foam insulation.

2. The panel of claim 1, wherein the spacer members have a facer material provided on at least one surface thereof.

3. The panel of claim 2, wherein the facer material is comprised of a material selected from the group consisting of aluminum foil, kraft paper, coated glass, glass-reinforced felt, and matted glass.

4. The panel of claim 2, wherein the spacer members have a facer material provided on parallel opposing surfaces thereof.

5. The panel of claim 1, wherein the spacer members are over three inches wide and are at least one-half inch thick.

6. The panel of claim 1, wherein the rigid nail-anchoring material is comprised of a material selected from the group consisting of plywood, waferboard, oriented strand board, and particle board.

7. The panel of claim 1, wherein the first sheet is comprised of an insulation material selected from the group consisting of polyurethane modified polyisocyanurate foam, phenolic-formaldehyde foam, and polystyrene foam.

8. The panel of claim 1, wherein the spacer members are comprised of a plastic foam insulation material selected from the group consisting of polyurethane modified polyisocyanurate foam, phenolic-formaldehyde foam, and polystyrene foam.

9. The panel of claim 1, wherein the panel has a first edge and a second edge parallel to the first edge, wherein edge spacer members positioned proximate the first edge and the second edge have a first width W1 across a first dimension extending from the first edge to the second edge, and wherein intermediate spacer members positioned between the first edge and the second edge have a second width W2 across the first dimension, the second width W2 being greater than the first width W1.

10. The panel of claim 9, wherein the first width W1 is on the order of about four inches, and wherein the second width W2 is on the order of about six inches.

11. The panel of claim 9, wherein a channel defined by a edge spacer member and an intermediate spacer member has a channel width CW1 across the first dimension; wherein a channel defined by two intermediate spacer members has a channel width CW2 across the first dimension; and wherein the second width CW2 is greater than the first width CW1.

12. The panel of claim 11, wherein the first channel width CW1 is on the order of about seventeen inches, and wherein the second width CW2 is on the order of about eighteen inches.

13. The panel of claim 1, wherein a plurality of the air channels have substantially the same width across a first dimension, the first dimension extending from a first edge to a second edge of the panel.

14. The panel of claim 13, wherein the air channels have a width in a range from about seventeen to about eighteen inches.

15. A thermally insulative building construction panel comprising:

a first sheet, the first sheet comprising an insulation material having a density less than 5 lb./cubic foot and an insulative "R" value in excess of 5.0 per inch thickness;

a second sheet, the second sheet comprising a rigid nail-anchoring material having a density in excess of 25 lb./cubic foot;

a plurality of spacer members connected in fixed positions between the first sheet and the second sheet for defining air channels between the sheets and the spacer members, the spacer members being directly connected to the first sheet and the second sheet for maintaining a spaced parallel relationship between the first sheet and the second sheet; and, wherein the panel has a first edge and a second edge parallel to the first edge, wherein edge spacer members positioned proximate the first edge and the second edge have a first width W1 across a first dimension extending from the first edge to the second edge, and wherein intermediate spacer members positioned between the first edge and the second edge have a second width W2 across the first dimension, the second width W2 being greater than the first width W1 and the first width being at least four inches.

16. The panel of claim 15, wherein the first width W1 is on the order of about four inches, and wherein the second width W2 is on the order of about six inches.

17. The panel of claim 15, wherein a channel defined by a edge spacer member and an intermediate spacer member has a channel width CW1 across the first dimension; wherein a channel defined by two intermediate spacer members has a channel width CW2 across the first dimension; and wherein the second width CW2 is greater than the first width CW1.

18. The panel of claim 17, wherein the first channel width CW1 is on the order of about seventeen inches, and wherein the second width CW2 is on the order of about eighteen inches.

19. The panel of claim 17, wherein the second sheet has an insulative "R" value less than 2.3 per inch thickness.

* * * * *